United States Patent [19]

Elliott

[11] 4,432,944

[45] Feb. 21, 1984

[54] ION EXCHANGE RECOVERY OF URANIUM

[75] Inventor: Henry H. Elliott, Pleasanton, Calif.

[73] Assignee: General Electric Company, San Jose, Calif.

[21] Appl. No.: 218,351

[22] Filed: Dec. 22, 1980

[51] Int. Cl.[3] ..... C01G 43/00

[52] U.S. Cl. ..... 423/7; 210/670; 210/672; 210/682

[58] Field of Search ..... 210/682, 670, 672; 423/7

[56] References Cited

U.S. PATENT DOCUMENTS 2,780,514 2/1957 Lutz ..... 210/682
2,999,821 9/1961 Fisher ..... 210/670

OTHER PUBLICATIONS

Prober, *Ion Exchange for Pollution Control,* vol. 1, CRC Press, Boca Raton, Fla., (1979), p. 14.

*Primary Examiner*—Herbert T. Carter
*Attorney, Agent, or Firm*—Ivor J. James, Jr.; Raymond G. Simkins; Samuel E. Turner

[57] ABSTRACT

A process for recovering soluble uranium with an anion exchange system from carbonate-containing water. The process includes means for overcoming the deleterious effects upon the ion exchange system of carbon dioxide gas resulting from the carbonate-contents of the water in the presence of an acidic elutriate.

23 Claims, 1 Drawing Figure

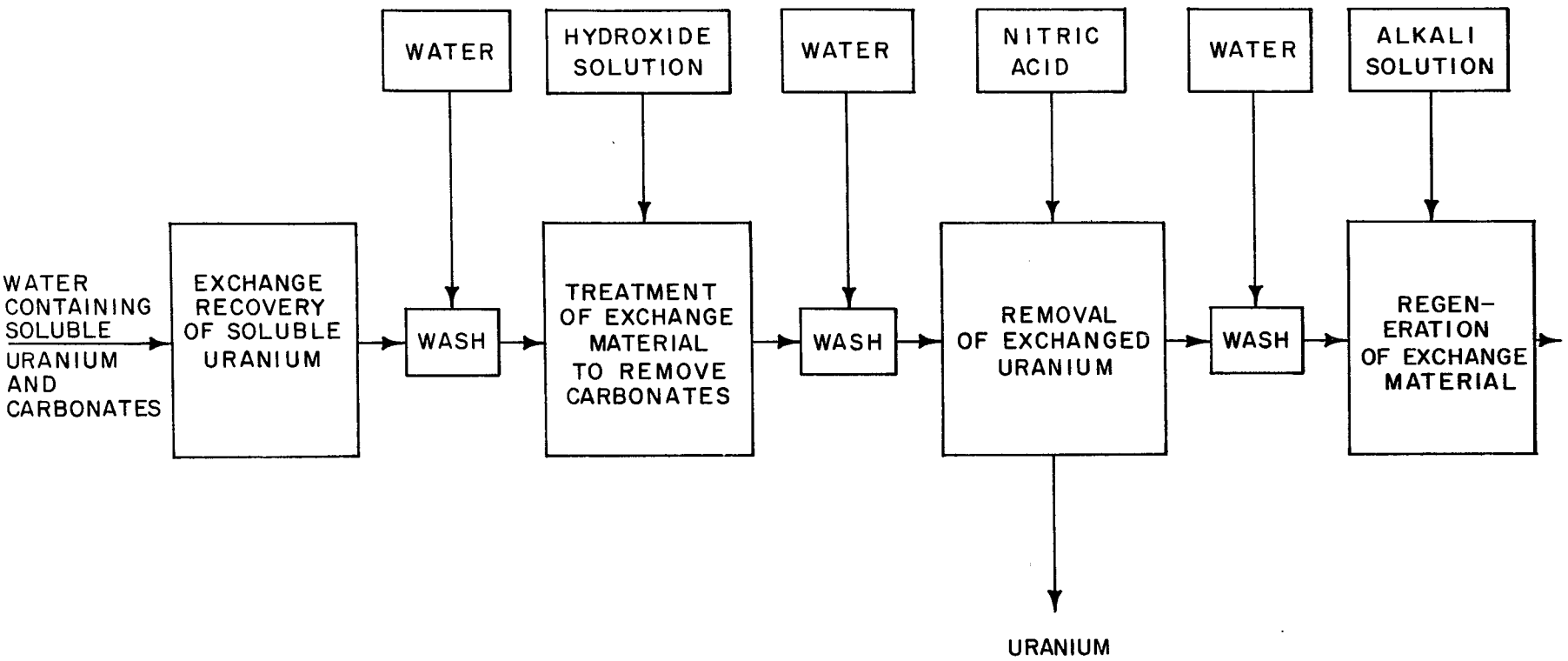
WATER CONTAINING SOLUBLE URANIUM AND CARBONATES
EXCHANGE RECOVERY OF SOLUBLE URANIUM
WATER
WASH
HYDROXIDE SOLUTION
TREATMENT OF EXCHANGE MATERIAL TO REMOVE CARBONATES
WATER
WASH
NITRIC ACID
REMOVAL OF EXCHANGED URANIUM
URANIUM
WATER
WASH
ALKALI SOLUTION
REGEN-ERATION OF EXCHANGE MATERIAL

ION EXCHANGE RECOVERY OF URANIUM

BACKGROUND OF THE INVENTION

1. Field of the Invention

This invention relates to an ion exchange process for recovering uranium from carbonate-containing waters or waste effluent. The method is particularly useful for treating process water or effluent derived from a common procedure for converting uranium hexafluoride to uranium dioxide of a grade suitable for use as fuel for nuclear fission reactors, or from solution containing dissolved uranyl carbonate anions from uranium ore leaching operations.

2. Description of the Background Art

One conventional means of producing fission fuel grade uranium dioxide consists of a wet conversion procedure, comprising the steps or reactions of: (a) hydrolyzing gaseous uranium hexafluoride ($UF_6$) with water to form water soluble uranyl fluoride ($UO_2F_2$) and hydrogen fluoride; (b) introducing ammonia ions, such as by the addition of an excess of ammonium hydroxide, to cause the soluble uranyl fluoride to precipitate as insoluble ammonium diuranate ($(NH_4)_2U_2O_7$); and, (c) upon separation of said insoluble precipitate from the water fraction, heating the ammonium diuranate to drive off entrained fluorides with the ammonia and thereby convert the diuranate to uranium dioxide ($UO_2$).

This basic uranium conversion process is disclosed in detail in the prior art, for example U.S. Pat. Nos. 3,394,997 and 3,579,311, and the disclosures and contents of said patents are incorporated herein by reference.

The ammonium fluoride containing effluent or process water derived from the aforesaid common uranium wet conversion procedure nevertheless retains relatively high proportions of soluble contents. In their existing chemical state the retained soluble contents are not amenable to removal by typical mechanical separating means such as by filtering, centrifuging or settling and decanting, and other physical techniques. The soluble contents include very significant amounts of about 10 to 70 parts per million of costly uranium as soluble complex fluoride, hydroxide, and carbonate anions, and mixed complex anions. The retention of such substantial amounts of valuable solubles in the aqueous system of this uranium hexafluoride to uranium dioxide wet conversion process, including significant quantities of uranium, and the economics and/or safety factors associated therewith, are subjects documented in the art, for example U.S. Pat. Nos. 3,726,650 and 3,961,027. The disclosures and contents of these patents are accordingly also incorporated herein by reference.

As noted in U.S. Pat. No. 3,726,650, the soluble uranyl complexes including fluoride, hydroxide, and carbonate anions, and mixed complex ions formed within the ammonium fluoride-containing water of the chemical system in the foregoing wet uranium conversion procedure are not readily recoverable. The soluble uranyl anions, or complexes thereof, have typically been removed in economically effective amounts from solution with strong basic anionic exchange materials, and subsequently stripped and removed therefrom for recovery with a strong mineral acid such as nitric acid. Acid salt solutions such as nitrate salts have been found not to be practical for stripping and removing uranium complexes from such anion exchange materials because of non-quantitative or low recovery results. Thus, an acid medium or presence is needed to provide a sufficient quantity of uranium removal and recovery from the ion exchange material to render the system practical and economically feasible.

Carbon dioxide gas has a strong propensity for, and rapid absorption rate into basic water solutions. This affinity renders it impractical or not cost recoverable to undertake to prevent carbon dioxide absorption from the air into basic aqueous media functioning within large production scale systems comprising storage tanks, settling basins and the like liquid handling units, such as those generally associated with the filters or centrifuges, ion exchange columns and the like in the commercial manufacture of uranium dioxide fuel by the wet conversion procedure. Moreover, water absorbed carbon dioxide, even in the parts per million quantity ranges, readily combines with uranyl ions and forms mono-, di- and triuranyl carbonate complex ions. Carbonates such as are typically formed in the basic aqueous medium of a wet uranium conversion procedure, concentrate on anion exchange material used in conjunction with the recovery of soluble complex uranium anions.

Any acid passing through a body of ion exchange material with carbonates retained or dispersed therein from uranium bearing, carbonate-containing water undergoing treatment acts upon the carbonates to produce and release large volumes of carbon dioxide gas throughout the ion exchange material. Ion exchange materials are typically employed as a bed of resin beads or particles and the released carbon dioxide gas in such large quantities as encountered under common conditions and contents with the aforesaid uranium wet conversion process, disrupts the integrity and continuity of the bed or body by raising or expanding and churning the mass of particles. Also pockets or voids of residual carbon dioxide gas can be formed within the exchange material which are difficult to remove and provide uneven flow channels or partial by-pass routes therethrough. Moreover, carbon dioxide gas enters into or forms within individual units or particles of the ion exchange material such as resin beads or granules. Thus any expansion of the gas at its inception, or due to heat and/or pressure changes can fracture or rupture a substantial proportion of the exchange material particles into small fragments. When diminished in particle size and uniformity, the costly ion exchange materials or particles are susceptible to high loss rates from the vessel or the system by being entrained and swept away within the liquid stream or current of the operating system. Particle loss is especially high when the exchange material is undergoing the usual treatments and/or rinsing for each rejuvenation cycle, an operation that typically entails the reverse or back flowing of a liquid through the exchange material and system for one or more steps thereof including flushing away entrained fines and recharging or generating expended exchange material.

Moreover, released gas within the system builds up pressure in the confines of ion exchange containers or column which can cause inadvertent rupture of such vessels or connections therewith and thereby create a hazard for both personnel and equipment.

SUMMARY OF THE INVENTION

This invention relates to an ion exchange process for the recovery of uranium from carbonate-containing water, wherein the overall operation includes an application of an acid within the system or to the ion exchange material. Acids are typically employed in ion exchange system for the performance of one or more phases of the process, such as releasing and removing uranium ions from the exchange material.

This invention comprises a combination and sequence of steps or operations performed with the ion exchange system, and specifically includes an application to the exchange material of a basic solution of ammonium hydroxide or a hydroxide of an alkali metal.

OBJECTS OF THE INVENTION

It is a primary object of this invention to provide an effective process for recovering uranium from carbonate-containing waters.

It is also a primary object of this invention to provide an improved ion exchange process for recovering uranium from carbonate-containing waters in essentially quantitative amounts without incurring debilitating effects upon the system or diminishing the effectiveness of the uranium recovery.

It is an additional object of this invention to provide a process for reclaiming uranium from carbonate-containing water with an ion exchange material, including an acid induced uranium removal and recovery step, that effectively precludes the formation of carbon dioxide gas and the many deleterious effects of such a gas upon the integrity of the exchange material and the system or its operation.

It is another object of this invention to provide an ion exchange process for recovering uranium from carbonate-containing water that enables the expeditious collection and combining of effluents from several treatment steps or operations of the ion exchange process, including the acid removal or stripping of the uranium retained therewith, and the effective recovery of uranium as yellow cake from the composite of said composite of combined effluents.

DESCRIPTION OF THE DRAWING

The drawing comprises a simplified block diagram illustrating the basic steps of the process of the present invention.

DETAILED DESCRIPTION OF THE INVENTION

This invention provides an efficient and economically feasible ion exchange process of the effective recovery of costly uranium from carbonate-containing waters with a minimum of destruction and loss of ion exchange material, or other disadvantages to the system.

In accordance with a typical and preferred embodiment of this invention, uranium is reclaimed from aqueous solutions comprising soluble uranium in the form of complex uranyl anions and containing carbonates and/or carbon dioxide gas derived therefrom by means of an anion exchange material according to the following procedure or combination and sequence of steps.

A mass of anion exchange resin particles or beads is suitably deposited and retained in an appropriate column or container to provide a bed or particulate body therein occupying about two-thirds the volume thereof in a conventional arrangement. If the exchange material is not already in charged form with a high concentration of exchangeable hydroxyl, carbonate or bicarbonate ions, it is converted thereto or charged with such ions with a solution of an ammonium or alkali metal hydroxide, carbonate or bicarbonate. For example about a 2 Normal sodium hydroxide solution is passed through the bed of exchange material in an adequate quantity to provide a high level of exchangeable ion content thereon, such as about 20 bed volumes. The exchange bed is then washed with water free of deleterious ions or compounds, such as distilled or deionized water to displace the hydroxide or other charging solution from about the exchange material or vessel containing same. An effective amount of water for the washing is about 5 exchange material bed volumes.

With the anion exchange material aptly prepared or charged with suitable hydroxyl, carbonate or bicarbonate exchange ions, the uranium reclaiming process can be initiated by contacting the mass of exchange material with an aqueous solution comprising soluble uranyl complex anions and also containing therein carbonates. A typical solution for ion exchange recovery is a filter or centrifuge clarified ammonium diuranate liquor from a uranium wet conversion process as noted above, or a solution containing dissolved uranyl carbonate anions as would be generated in a uranium ore leaching operation. Contact is generally effected by flowing the solution through the mass of exchange material. The complex uranyl anions of the solution, upon contact, are thus exchanged with the hydroxyl, carbonate or bicarbonate ions of the anion exchange material and thereby removed from solution and retained on the exchange material. Completion of the ion exchange operation, or exhaustion of the exchange materials available interchangeable hydroxyl, carbonate or bicarbonate ions can be determined by standard analytical techniques for detecting uranium ion in the effluent from the exchange operation.

Upon completion of the exchange operation, the mass of exchange material having the uranium ions retained thereon, is washed with water or dilute ammonium hydroxide solution to displace the carbonate-containing uranium solution from about the exchange material or within the vessel containing same. Ammonium hydroxide solution, if used, can be about 0.5 Normal in strength, and a typical quantity of wash liquid for this stage is about 5 exchange material bed volumes.

In accordance with this invention, the ion exchange material having the uranium ions retained thereon, is treated to expel any carbonate contained or retained therein or within the vessel containing same by passing therethrough a solution of a hydroxide of ammonium or a metal such as an alkali metal, and preferably sodium hydroxide. Metal or ammonium hydroxide solutions of at least about 1 Normal in strength are suitable. Preferably about a 2 to 4 Normal solution of ammonium or sodium hydroxide is applied in amounts of about 10 exchange material bed volumes and at a flowrate therethrough of about 3 to 20 volumes per hours. The effluent from this treatment can advantageously be collected and retained for future recovery.

Following the hydroxide treatment, the exchange material having the uranium ions retained thereon preferably is again washed with water to displace any of the free hydroxide solution from about the exchange material of within the vessel containing same.

The diuranate formed on the exchange material is next removed or stripped from the exchange material for subsequent recovery by contacting said exchange material with an inorganic acid. For example, about 0.5 Normal nitric acid is applied in quantities of about 10 exchange material bed volumes, or in such strengths and quantities sufficient to release a substantial majority of the uranium ions from the exchange material.

The ion exchange material freed of its uranium content by the acid is preferably again washed with water to displace any acid from about the exchange material or within the vessel containing same.

Finally, as a practical matter to thereafter repeat the uranium recovery process, the ion exchange material having been expended by the aforedescribed uranium reclamation, is regenerated or recharged by its conversion back to a hydroxyl, carbonate or bicarbonate form. That is the material is again loaded with such exchangeable ions for repeating the recovery procedure. This, as before, is achieved by passing a solution of an ammonium or alkali metal hydroxide, carbonate or bicarbonate, for example about a 2 Normal sodium hydroxide solution, through the bed thereof in an adequate quantity to provide a high level of such exchangeable ion content. thereon, e.g., about 20 or more exchange material bed volumes. Preferably the exchange material thus loaded with hydroxyl, carbonate or bicarbonate ions is washed with water to displace the hydroxide or carbonate solution from about the exchange material or vessel containing same, in amount of about 5 exchange material bed volumes.

Washing of the exchange material to displace any residual material of a previous application or step should be effected with a liquid free of any ions or contaminants that will effect or alter the performance and objects of the invention. For instance, to insure the absence of any interfacing or deleterious water-borne agents, it is preferred to use purified water such as distilled or deionized water.

This process as described above, essentially precludes the formation of carbon dioxide gas within or about the exchange material, and vessel containing same, Thus, the reclamation of uranium from carbonate-containing water with an anion exchange material can be effectively carried out without substantial losses of expensive ion exchange material through the fracture of the particles thereof and the entrainment and sweeping away of such diminished particles within liquid streams flowing therethrough, and other given adverse effects of carbon dioxide gas within the system.

A significant advantage of the aforedescribed process of this invention, aside from the primary objective of overcoming the formation of carbon dioxide gas within the exchange material system and the deleterious effects thereof, is that the process further provides for an advantageous and convenient uranium recovery procedure. The several effluents from the nitric acid removal of retained diuranate from the exchange material, the hydroxide treatment of the exchange material having the uranium ions retained thereon, and the intermediary washings for the expulsion or replacement of the components of a previous application, are all collected together and treated as one for the recovery of uranium therefrom. The composite of such effluents can be agitated and permitted to crystallize into a sodium or ammonium diuranate ($(Na)_2U_2O_7$) or ($(NH_4)_2U_2O_7$) product. This precipitate, commonly referred to as yellow cake, is recovered by conventional liquid-solid separation techniques, such as sedimentation, filtration or centrifugation. The pH of the collected effluents should be adjusted to about 12 to minimize the solubility of the sodium diuranate.

The ion exchange apparatus used in the uranium recovery process of this invention can comprise simple vertical fixed bed columns, fluidized upflow columns, continuous Higgins columns, or continuous horizontal screw conveyor type ion exchange devices. Moreover, the ion exchange material can comprise strong basic anion exchange materials or resins such as Dow Chemical's Dowex products, Rohm & Hass' Amberlite products and the like anion exchange products.

The following comprises a specific example illustrating means for the practice of this invention. The ion exchange recovery of uranium in this exemplary embodiment of the invention was performed with 250 ml of wet Dowex 2×4 anion exchange resin (Dow Chemical) half-filling a 40 inch tall column of 0.75 $in^2$ diameter. The steps are as follows: (1) The anion exchange material was first washed with 1250 ml of deionized water to elutriate or flush away any entrained fines, (2) then regenerated by passing 5000 ml of 2 Normal sodium hydroxide solution through the bed. (3) Any residual caustic was displaced and washed away with 1250 ml of deionized water. (4) Then 4000 ml of a solution containing 44 grams of ammonium carbonate ($(NH_4)_2CO_3$), 8 grams or uranyl nitrate ($UO_2(NO_3)_2.6H_2O$), and 15.2 grams of ammonium fluoride ($NH_4F$) was brought into contact with the ion exchange material by passing through the column thereof. (5) Residual solution thereof was displaced and washed away with 1250 ml of 0.5 N ammonium hydroxide. (6) Then 2500 ml of 2 N sodium hydroxide was passed through column. (7) This was followed with 1250 ml of deionized water to wash away excess sodium hydroxide. (8) Uranium ions were then removed or stripped from the exchange material with 2500 ml of 0.5 Normal nitric acid passed through the column. (9) Residual acid was displaced and washed away with 1250 ml of deionized water. (10) The exchange material was then regenerated with 5000 ml of 2 Normal sodium hydroxide.

The effluents from the above steps 6, 7, 8 and 9 were all collected and combined, then centrifuged to separate out the precipitated sodium diuranate or yellow cake. In excess of 90 percent of the initial uranium content of solution was recovered from the combined effluents as yellow cake.

What is claimed is:

1. A process for recovering soluble uranium with an ion exchange material from carbonate-containing water, comprising the combination and sequence of steps of:

(a) contacting carbonate-containing water having soluble uranium therein with a mass of ion exchange material charged with at least one exchangeable ion selected from the group consisting of hydroxyl, carbonate and bicarbonate ions, and thereby removing and retaining thereon uranium ions from said carbonate-containing water;

(b) treating the mass of ion exchange material having the uranium ions retained thereon by passing therethrough a solution of a hydroxide selected from the group consisting of a metal hydroxide and ammonium hydroxide to expel any carbonate contained therein; and (c) removing the retained ions comprising uranium from the ion exchange material by contacting said material with an acid and recovering the uranium.

2. The process of claim 1, wherein the ion exchange material expended by the uranium recovery is regenerated by contacting said expended exchange material with at least one alkali solution selected from the group consisting of hydroxides, carbonates and bicarbonates of a metal or ammonium.

3. The process of claim 2, wherein the alkali solution for regenerating the ion exchange material is a solution of an alkali metal hydroxide.

4. The process of claim 1, wherein the mass of ion exchange material having uranium ions retained thereon from contacting said carbonate-containing water, is washed with dilute ammonium hydroxide solution to displace the carbonate-containing water from about the exchange material.

5. The process of claim 1, wherein the acid for removing any retained ions comprising uranium is nitric acid.

6. The process of claim 1, wherein the metal hydroxide for treating the mass of ion exchange material is an alkali metal hydroxide.

7. A process for recovering soluble uranium with an ion exchange material from carbonate-containing water, comprising the combination and sequence of steps of:

(a) contacting carbonate-containing water having soluble uranium therein with a mass of particulate ion exchange material charged with at least one exchangeable ion selected from the group consisting of hydroxide, carbonate and bicarbonate ions, and thereby removing and retaining thereon uranium ions from said carbonate-containing water;

(b) washing the mass of ion exchange material having the uranium ions retained thereon with water to displace the carbonate-containing water from about the exchange material;

(c) treating the mass of ion exchange material having the uranium ions retained thereon by passing therethrough a solution of a hydroxide selected from the group consisting of an alkali metal hydroxide and ammonium hydroxide to expel any carbonate contained therein;

(d) removing retained ions comprising uranium from the ion exchange material by contacting said material with a mineral acid and recovering the uranium; and (e) regenerating the ion exchange material by contacting the ion exchange material expended by the uranium recovery with at least one alkali solution selected from the group consisting of hydroxides, carbonates and bicarbonates of an alkali metal and ammonium to thereby charge said exchange material with exchangeable ions.

8. The process of claim 7, wherein the water for washing the mass of ion exchange material having uranium ions retained thereon to displace the carbonate-containing water from about the exchange material comprises a solution of ammonium hydroxide.

9. The process of claim 7, wherein the mineral acid for removing any retained ions comprises uranium is nitric acid.

10. The process of claim 7, wherein the alkali solution for regenerating the expended ion exchange material is a solution of sodium hydroxide.

11. The process of claim 7, wherein the alkali solution for regenerating the expended ion exchange material is a solution of ammonium hydroxide.

12. The process of claim 7, wherein the mass of ion exchange material having had any retained ions comprising uranium removed therefrom by contact with a mineral acid, is washed with water to displace any mineral acid remaining thereabout.

13. The process of claim 7, wherein the solution of a hydroxide for treating the mass of ion exchange material comprises a solution of sodium hydroxide.

14. A process for recovering soluble uranium with an anion exchange material from carbonate-containing water, comprising the steps of:

(a) contacting carbonate-containing water having soluble uranium therein with a mass of particulate anion exchange material charged with at least one exchangeable ion selected from the group consisting of hydroxyl, carbonate or bicarbonate ions, and thereby removing and retaining thereon uranium ions from said carbonate-containing water;

(b) washing the mass of anion exchange material having the uranium ions retained thereon with water to displace the carbonate-containing water from about the exchange material;

(c) treating the mass of anion exchange material having the uranium ions retained thereon by passing therethrough a solution of a hydroxide selected from the group consisting of an alkali metal hydroxide and ammonium hydroxide to expel any carbonate contained therein;

(d) washing the mass of anion exchange material having the uranium ions retained thereon with water to displace the solution of a hydroxide from about the exchange material;

(e) removing retained ions comprising uranium from the anion exchange material by contacting said material with nitric acid and recovering the uranium;

(f) washing the mass of anion exchange material having had the retained uranium ions removed therefrom with water to displace any nitric acid from about the exchange material; and (g) regenerating the anion exchange material by contacting the ion exchange material expended by the uranium recovery with at least one alkali solution selected from the group consisting of hydroxides, carbonates, and bicarbonates of an alkali metal and ammonium to thereby charge said exchange material with exchangeable ions.

15. The process of claim 14, wherein the water for washing the mass of anion exchange material having uranium ions retained thereon to displace the carbonate-containing water from about the exchange material comprises a solution of ammonium hydroxide.

16. The process of claim 14, wherein the alkali solution for regenerating the expended ion exchange material is a solution of sodium hydroxide.

17. The process of claim 14, wherein the alkali solution for regenerating the expended ion exchange material is a solution of ammonium hydroxide.

18. The process of claim 14, wherein the alkali solution for regenerating the expended ion exchange material is a solution of sodium carbonate.

19. The process of claim 14, wherein the alkali solution for regenerating the expended ion exchange material is a solution of ammonium carbonate.

20. The process of claim 14, wherein the solution of a hydroxide for treating the mass of ion exchange material comprises a solution of sodium hydroxide.

21. A process for recovering soluble uranium with an anion exchange material from carbonate-containing water, comprising the steps of:

(a) contacting carbonate-containing water having soluble uranium therein with a mass of particulate anion exchange material charged with at least one exchangeable ion selected from the group consisting of hydroxide, carbonate and bicarbonate ions and thereby removing and retaining thereon uranium ions from said carbonate-containing water;

(b) washing the mass of anion exchange material having the uranium ions retained thereon with a solution of ammonium hydroxide to displace the carbonate-containing water from about the exchange material;

(c) treating the mass of particulate anion exchange material having the uranium ions retained thereon by passing therethrough a solution of a hydroxide selected from the group consisting of sodium hydroxide and ammonium hydroxide to expel any carbonate entrained within the mass of particulate exchange material;

(d) washing the mass of anion exchange material having the uranium ions retained thereon with water to displace the basic solution from about the exchange material;

(e) removing retained ions comprising uranium from the anion exchange material by contacting said exchange material with nitric acid and recovering the removed uranium from the resultant effluent;

(f) washing the mass of anion exchange material having had the retained uranium ions removed therefrom with water to displace any nitric acid from about the exchange material; and (g) regenerating the mass of anion exchange material by contacting the ion exchange material expended by the uranium recovery with at least one alkali solution selected from the group consisting of hydroxides, carbonates and bicarbonates of sodium and ammonium to thereby charge said anion exchange material with exchangeable ions.

22. A process for recovering soluble uranium with an anion exchange resin from carbonate-containing water, comprising the steps of:

(a) contacting carbonate-containing water having soluble complex uranyl anions therein with a mass of particulate anion exchange resin charged with hydroxyl ions and thereby removing and retaining thereon complex uranyl anions from said carbonate-containing water;

(b) washing the mass of anion exchange resin having the complex uranyl anions retained thereon with water to displace the carbonate-containing water from about the exchange resin;

(c) treating the mass of particulate anion exchange resin having the complex uranyl anions retained thereon by passing therethrough a solution of sodium hydroxide to expel any carbonate entrained within the mass of particulate exchange resin;

(d) washing the mass of anion exchange resin having the complex uranyl anion retained thereon with water to displace the sodium hydroxide solution from about the exchange resin;

(e) removing any retained complex uranyl anions from the anion exchange resin by contacting said exchange resin with nitric acid and recovering the removed complex uranyl anions from the resultant effluent;

(f) washing the mass of anion exchange resin having had the retained complex uranyl anions removed therefrom with water to displace any nitric acid from about the exchange resin; and, (g) regenerating the mass of anion exchange resin by contacting the anion exchange resin expended by the uranium recovery with a solution of sodium hydroxide to thereby charge said anion exchange resin with hydroxyl ions.

23. The process of claim 22, wherein the soluble complex uranyl anions comprise uranium complexes with fluoride, hydroxide, and carbonate anions, and mixed complex ions thereof.

* * * * *